United States Patent [19]

Englund

[11] 4,082,035

[45] Apr. 4, 1978

[54] HIGH SPEED PRINTER HAVING SEGMENTED DRUM

[75] Inventor: Gösta Roland Englund, Stockholm, Sweden

[73] Assignee: Svenska Dataregister AB, Sweden

[21] Appl. No.: 779,125

[22] Filed: Mar. 18, 1977

Related U.S. Application Data

[63] Continuation of Ser. No. 593,153, Jul. 3, 1975, abandoned, which is a continuation of Ser. No. 406,090, Oct. 12, 1973, abandoned.

[30] Foreign Application Priority Data

Nov. 2, 1972 Sweden ..... 14234/72

[51] Int. Cl.[2] ..... B41J 3/06

[52] U.S. Cl. ..... 101/93.04; 101/93.29

[58] Field of Search ..... 197/1 R; 101/93.04, 101/93.05, 93.09, 93.23; 178/30, 23

[56] References Cited

U.S. PATENT DOCUMENTS

| | | | |
|---|---|---|---|
| 2,658,106 | 11/1953 | Hell | 197/1 R |
| 3,279,363 | 10/1966 | Christoff et al. | 101/93.04 |
| 3,324,240 | 6/1967 | Kleinschmidt et al. | 101/93.04 X |
| 3,750,794 | 8/1973 | Griggs | 101/93.23 X |
| 3,804,008 | 4/1974 | Hoyer | 197/1 R X |
| 3,810,195 | 5/1974 | Kilroy et al. | 346/101 |

OTHER PUBLICATIONS

Farmer, "Segment Printer" IBM Tech. Disc. Bull, vol. 14, No. 3, Aug. 1971.

*Primary Examiner*—Paul T. Sewell

*Attorney, Agent, or Firm*—Robert F. Rotella; Norman Friedman

[57] ABSTRACT

A printing device for printing characters onto a record medium comprising: a printing station; a carrier provided with a plurality of character segments, the character segments being adapted to collectively define an entire font of characters; a moving mechanism for intermittently moving the carrier to thereby move a particular one of the character segments through the printing station during each such intermittent movement of the carrier; a record feeding mechanism for intermittently feeding the record medium through a predetermined amount through the printing station; a hammer for striking the record medium against the carrier; and a control device for controlling the moving mechanism and the record feeding mechanism in a predetermined sequence of steps; the moving mechanism moving the carrier under control of the control device during particular steps in the predetermined sequence of steps; the record feeding mechanism feeding the record medium through the predetermined amount under control of the control device during certain steps in the predetermined sequence of steps; the carrier and the record medium being independently moved during specified steps and being simultaneously moved during other specified steps in the predetermined sequence of steps; the control device selectively actuating the hammer to thereby print the particular one of the character segments located at the printing station onto said record medium; whereby a character is formed by selective actuation of the hammer after controlled movement of the carrier and the record medium.

5 Claims, 9 Drawing Figures

Figure 1:
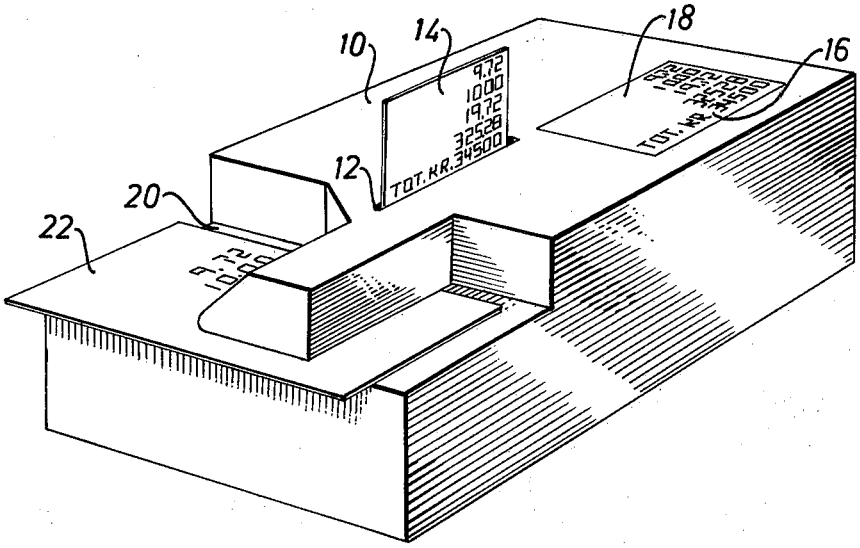

Fig. 5
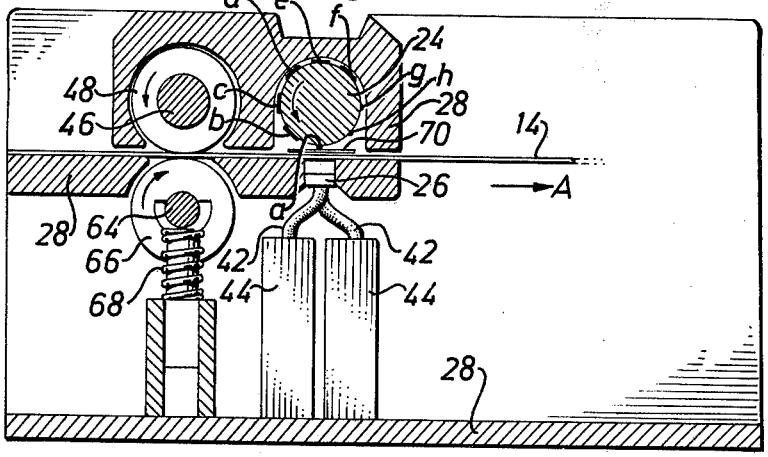
Fig. 6
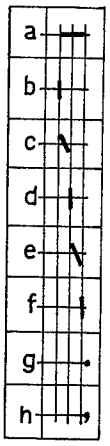
Fig. 7
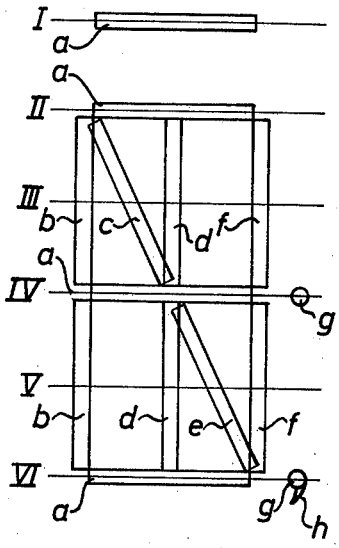
Fig. 8
| P | S | T | F |
|---|---|---|---|
| 1 | a | | |
| 2 | | | F |
| 3 | a | | |
| 4 | | T | F |
| 5 | b | | |
| 6 | | T | |
| 7 | c | | |
| 8 | | T | |
| 9 | d | | |
| 10 | | T | |
| 11 | | T | |
| 12 | f | | |
| 13 | | T | F |
| 14 | g | | |
| 15 | | T | |
| 16 | | T | |
| 17 | a | | |
| 18 | | T | F |
| 19 | b | | |
| 20 | | T | |
| 21 | | T | |
| 22 | d | | |
| 23 | | T | |
| 24 | e | | |
| 25 | | T | |
| 26 | f | | |
| 27 | | T | F |
| 28 | g | | |
| 29 | | T | |
| 30 | h | | |
| 31 | | T | |
| 32 | a | | |
| 33 | | | F |

100
101
102
102a
102b
102o
103
104
104a
104b
104f
106
106a
106b
106c
106o
106p
106q
107
108
108a
109
110
112
112a
112b
112c
112p
114
116
30
44
56
92
93

HIGH SPEED PRINTER HAVING SEGMENTED DRUM

This is a continuation, of application Ser. No. 593,153 filed July 3, 1975, abandoned, which is a continuation of Ser. No. 406,090, filed Oct. 12, 1973 for PRINTING DEVICE, now abandoned.

The present invention relates to a printing device for printing characters onto a record medium, comprising at least one printing station, a carrier supporting a plurality of segments included in the characters, said carrier being arranged to move the segments in sequence through said printing station, means for feeding the record medium through the printing station, an actuator for actuating the record medium when a selected one of said segments on said carrier is located in the printing station, the feed means being arranged to feed the record carrier intermittently through the printing station and the activator being arranged to be activated when the record medium takes rest position.

A large number of different electronically controlled, rapid printing devices are known in the art. One such printing device comprises a constantly rotating cylinder which supports different character types around its periphery in a number of rows and which, upon activation of electromagnets arranged at the printing stations, transfers the configuration of the types to a record medium, the record medium normally being stationary during the printing operation and having, for example, the form of a paper tape or slip. In order to be able to print alpha-numerical characters with such a device, it is necessary to arrange at least 36 types around the periphery of the cylinder in each column. This causes the diameter of the cylinder to be relatively large and the access time for selecting the different characters relatively long.

Another type of printing device is disclosed in German Patent No. 1,248,341, with which segment types arranged around the periphery of a rotating cylinder in combination form any alpha-numerical character whatsoever on a record medium when electromagnets arranged at the printing station are energized. Since it is necessary to arrange 20 types around the periphery of the cylinder in each column, the diameter of the cylinder with this device is also relatively large and the access time for character selection is long. Furthermore, the means for rotating the cylinder is very complicated.

The disadvantages encountered with the known printing devices are at least substantially eliminated by means of the printing device of the present invention, which provides a carrier supporting a plurality of character forming segments, said carrier being arranged to move the segments in sequence through a printing station, a record medium feed means and an actuator which is arranged to urge the record medium against the carrier, the arrangement being such that coordinated movement of the carrier, repeated advancement (feed) of the record medium and selective activation of the actuator combines the segments to one of the different characters.

Figure 2:
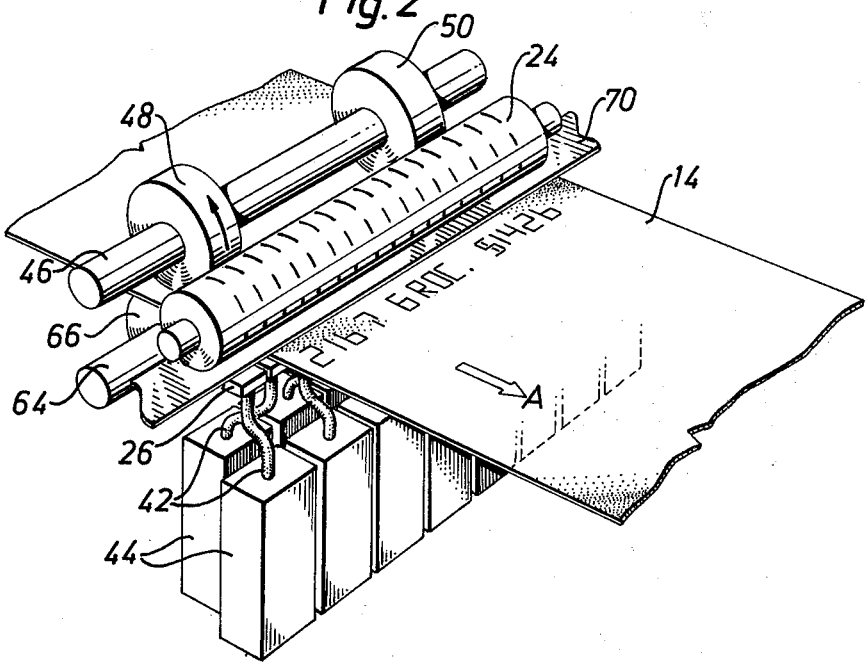
Figure 3:
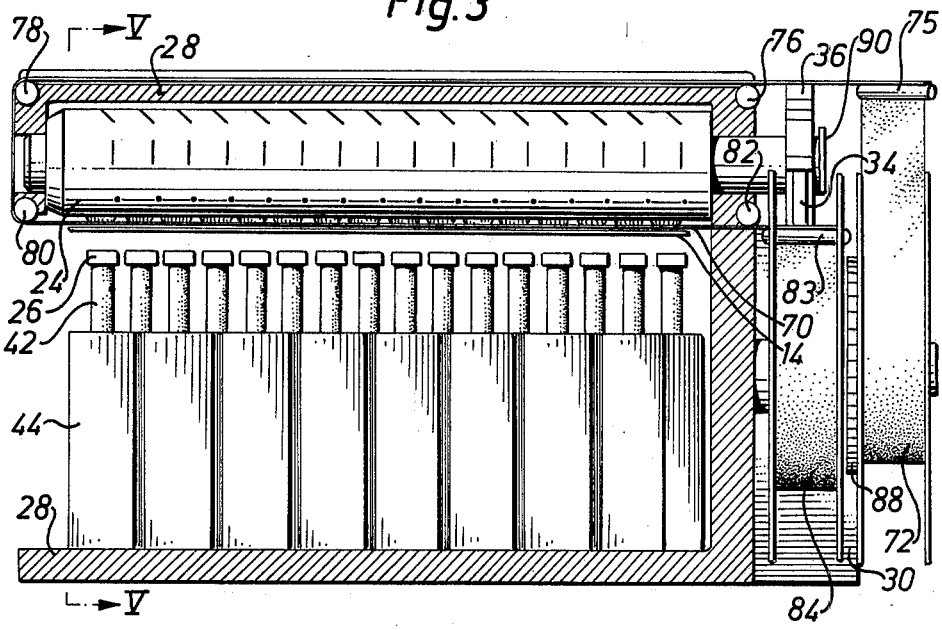
Figure 4:
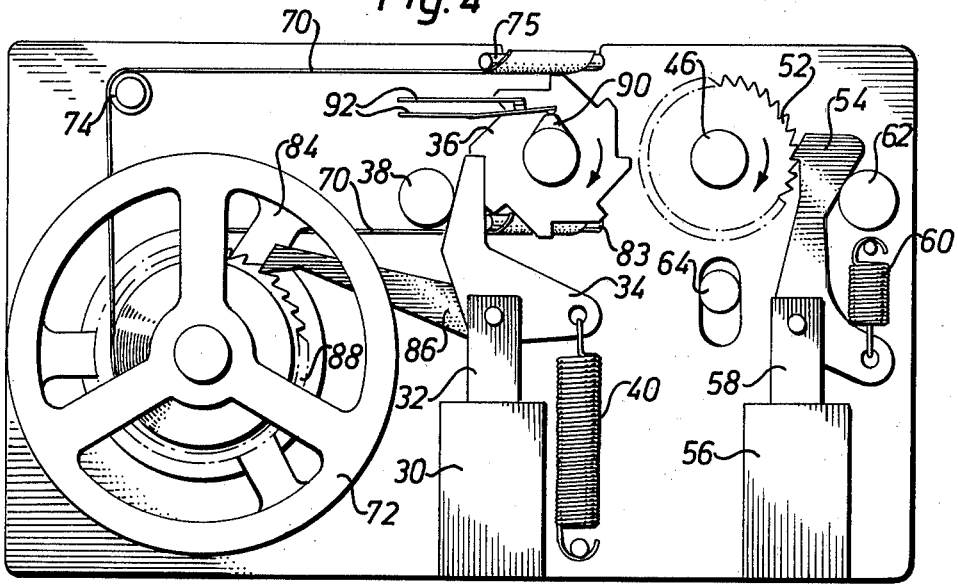
Figure 9:
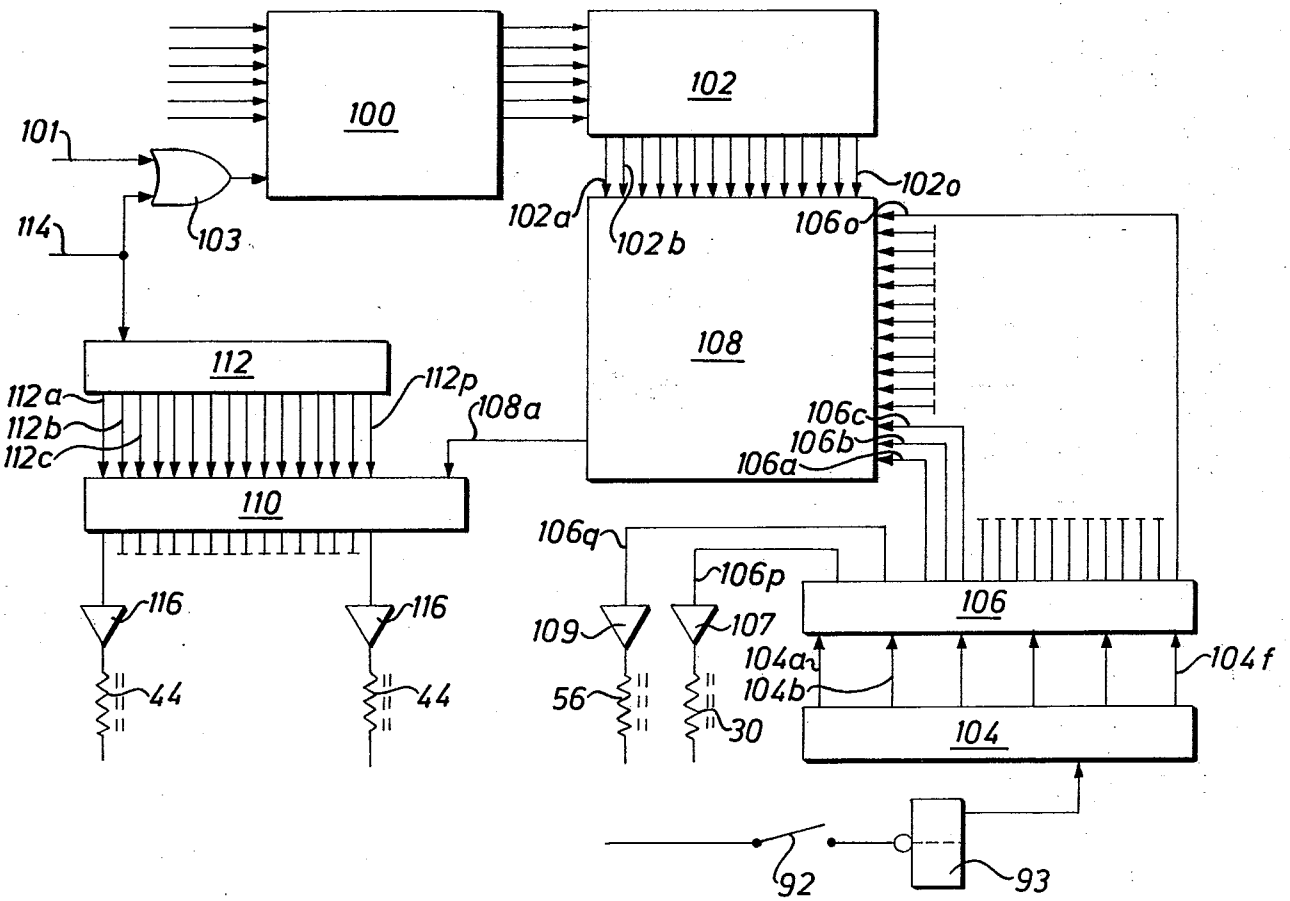

Other features and advantages of the printing device will be apparent from the following detailed description, which is made with reference to one embodiment of the invention illustrated in the accompanying drawings, of which FIG. 1 is a perspective view of a casing housing the device of the present invention, FIG. 2 is a perspective view of the main components of the device, FIG. 3 is a plan view of the device seen from the front, FIG. 4 is a plan view of the device seen from the right hand side of FIG. 3, FIG. 5 is a sectional view taken through the line V—V in FIG. 3, FIG. 6 is a table showing the positioning of the different segments on the cylinder according to FIGS. 2, 3 and 5, FIG, 7 shows the number of segments required according to FIG. 6 and in which positions these segments are pressed to form any alpha-numerical character whatsoever in upper-casement letters, FIG. 8 is a table showing the program required to print all the segments shown in FIG. 7, and FIG. 9 illustrates graphically the main components for the electronic control of the printing device according to the invention.

FIG. 1 shows the printing device of the present invention housed in a casing 10. As shown in the Figure, the printing device may be a separate unit, but may also be mounted in, for example, a calculating machine, such as an electronic cash register. Arranged in the casing 10 is a slot 12, from which a printed receipt 14 is obtained, and a window 16, through which a check ribbon or audit strip 18 can be seen. A slip table 20 having a bill 22 is located at one end of the device. Thus the illustrated printing device has three spaced apart printing stations or positions, although the number of printing positions may, naturally, be fewer or greater than that of the illustrated device.

FIG. 2 shows the receipt printing station. The receipt ribbon or slip 14 is located between a cylinder 24 and a row of print hammers 26. The cylinder 24 is arranged for rotation in the frame 28 of the device (FIG. 3) and is caused to be rotated intermittently (anticlockwise in FIG. 2) by an electromagnet 30 (FIG. 4), the core 32 of which is caused to move upwards upon energization of the electromagnet, wherewith an angled arm or pawl 34 rotatably connected to the core moves through one step an index wheel 36 fixedly attached to one end of the cyliner 24 and provided with eight teeth. During a printing operation, the upper part of the arm or pawl 34 bears against both the wheel 36 and a shaft 38 secured in the frame, whereby the cylinder 24 obtains an accurately defined position in its direction of rotation. In FIG. 4 the arm 34 is shown to be spring-biassed in a downward and clockwise direction, and a spring 40 provided for the purpose will thus move the core 32 and the arm downwards when the electromagnet 30 is de-energized at the same time as its swings the arm clockwise so as to enable the cylinder 24 to be moved clockwise through a further step with the next energizing cycle, FIG. 4.

The printing hammers 26 are in the form of plates made of some suitable, hard material and are attached to cores 42 which are arranged to move upwardly and downwardly when associated electromagnets 44 are magnetized and demagnetized respectively. The printing hammers 26 are arranged in one row and the electromagnets 44 are in two rows, securely mounted in the machine frame 28.

The cylinder 24 is provided with sixteen columns of character-forming markings or segments, of which eight such segments are spirally placed around the periphery of the cylinder in each column. Although with the illustrated embodiment the cylinder has sixteen columns of segments, this number is not restrictive of the invention and any number of columns can be provided. If the printing device shown in FIG. 1 and having three printing stations is to be used, a much larger number of columns is required and these columns are suitably arranged on one and the same cylinder, i.e., the cylinder 24 will extend substantially along the whole length of the casing 10.

The receipt slip 14 is moved in the direction of the arrow A by rubber rollers 48 and 50 securely mounted on a shaft 46. The shaft 46 is rotatably mounted at its ends in the frame 28 and is given an intermittent, rotary movement (clockwise as seen in FIG. 4) by an indexing wheel 52 which is mounted to the shaft 46 and which is moved through one step each time an angled arm or pawl 54 co-acting with the teeth of wheel 52 is moved downwards, FIG. 4. The pawl 54 is pivotally mounted on the core 58 of an electromagnet and is activated at its right-hand lower portion by a spring 60 attached to the frame, said pawl obtaining a downward movement when the electromagnet is magnetized, this movement being stopped when the pawl 54 bears against the stationary shaft 62. As a result of the co-action of pawl 54 with the shaft 62 and the wheel 52, there are obtained accurately defined angles of rotation for the shaft 46 whilst eliminating at the same time unintentional rotation of said shaft during a printing operation. When the magnet 56 is de-energized, the spring 60 assists in moving the core 58, and therewith the pawl 54, upwards as seen in FIG. 4.

A shaft 64 is mounted for rotation in the frame 28 beneath the slip 14, opposite the shaft 46. Two rubber rollers, of which, one, 66, is shown in FIGS. 2 and 5, are located opposite the rollers 48 and 50 on the shaft 46 and are arranged to urge the slip 14 against said rollers by means of one or more pressure springs, one such spring, 68, being shown in FIG. 5.

It will be perceived that when the magnet 56 is energized, the shaft 46 will be turned through a distance corresponding to the movement of slip 14 one step in the direction of arrow A.

Between the slip 14 and the cylinder 24 there is located an inked ribbon or printing ribbon 70 which extends from a storage reel 72 (FIGS. 2–4) over guide rollers 74, 75, 76, 78, 80, 81, 82 and 83, arranged in the frame, to a take-up reel 84. The reel 72 is arranged to be moved anticlockwise intermittently (as seen in FIG. 4) by the core 32 via an arm or pawl 86 and a cog wheel 88 attached to the reel 72, each time the magnet 30 is energized, whereby the printing ribbon 70 is moved through a certain distance of sufficient magnitude to ensure error-free printing of the slip 14 at each printing moment. In accordance with an alternative embodiment, the ribbon 70 may be arranged for movement in the same direction as the slip 14, but if a large number of columns is to be printed on the slip and/or more printing stations are to be used, the width of the ribbon will be so large as to render its handling difficult.

As hereinbefore mentioned, eight different segments are arranged in each column on the cylinder 24, different combinations of said segments forming certain characters. These segments are shown in FIG. 6. As will be seen, segment *a* comprises a horizontal line, segment *b* a vertical line, which is located immediately beneath the front edge of line *a*, segment *c* is an oblique line, the upper end of which is situated beneath line *b* and the lower end of which is situated beneath the centre portion of line *a*, segment *d* is an oblique line, the upper end of which is beneath the line *d* and the lower end of which is immediately beneath the rear edge of line *a*, while segment *f* comprises a vertical line located beneath the rear edge of line *a*. The segment *g* comprises a dot placed slightly to the right of line *f* and the segment *h* comprises a comma sign placed immediately beneath the dot *g*.

The segments *a–h* are arranged spirally in uniform spaced apart relationship around the periphery of drum 24, i.e., a character is located on each 45th degree of the cylinder periphery, the line *a*, for instance, being situated in the starting position of the cylinder, i.e., 0°, the centre of line *b* then being located 45° from the starting position, the centre of line *c* being located 90° from the starting position, the centre of line *d* being located 135° from the starting position, and so on.

All segments *a–h* are shown in FIG. 7, said segments together forming a certain character. Other characters can be formed by removing certain segments. Thus, the segment *a* in positions II and IV in FIG. 7, the segment *b* in the positions III and V and the segment *f* in the positions III and V form the letter A. The letter B is formed by the segment *b* in the positions III and V, the segment *f* in the positions III and V and the segment *a* in the positions II, IV and VI. The letter C is formed by the segment *a* in the positions II and VI and by the segment *b* in the positions III and V. The numeral 1 is formed by the segment *d* in the positions III and V, the numeral 2 is formed by the segment *a* in the positions II, IV and VI, the segment *f* in position III and the segment *b* in position V. As will be understood, any capital letter in the Roman alphabet or any numeral in the decimal system and certain punctuation marks, such as the period *g*, the comma *h*, the colon and semicolon, and other characters, such as + and −, can be printed on slip 14 by energizing a printing hammer 26 in a column one or more times (a maximum of 16 times) during rotation of the cylinder 24 under two revolutions and by advancing the slip 14 six steps (the positions I–VI in FIG. 7) during these revolutions.

FIG. 8 shows in table form the program required for printing any one of the beforementioned characters. In column P the 33 requisite programmes or steps are numbered in the order they occur during two revolutions of the cylinder 24. The segments *a–h* printed during the different program steps are shown in column S. Column T shows in which program steps the cylinder 24 is turned one step, i.e., 45°. Column F shows in which program steps the slip 14 is advanced through one step in the direction of arrow A, i.e., through a distance corresponding to the distance between two adjacent positions. As will be seen from FIG. 8, the segment or line *a*, for example, can be printed four times during two revolutions of the cylinder 24 (program 1, 3, 17 and 32), the segment or line *c* can be printed once (program 7) and the segment *g* twice (program 14 and 28). In order to print the letter N for example, the cylinder 24, by means of the electromagnet 44 which is energized at a predetermined point of time, will print in program steps 5 (segment *b* in position III), 7 (segment *c* in position III), 12 (segment *f* in position III), 19 (segment *b* in position V), 24 (segment *e* in position V) and *f* (segment *f* in position V). During each program step 4, 6, 8, 10, 11, 13, 15, 16, 18, 20, 21, 23, 25, 27, 29 and 31, the cylinder 24 will be rotated one step and during each program step 2, 4, 13, 18, 27 and 33, the slip 14 wil be advanced in the direction of the arrow through a distance which corresponds for example to half of the length of the vertical line *b* (or *d* or *f*).

Securely attached to the end of the cylinder 24 remote from the wheel 36 is a contact arm 90 which, when the cylinder is located in its starting position, closes a switch 92 of suitable type mounted in the frame 28. The switch 92 is shown in FIG. 4 and in FIG. 9, where it is connected in series with a bistable flip-flop 93.

Also shown in FIG. 9 is shift register 100 to which signals are applied from the calculating machine (not shown) connected to the printer of the present invention. The signals applied to the shift register 100 during each working cycle represent 16 characters, each of which comprises 6 bits. During a working cycle 16 characters are clocked into the shift register 100 via a line 101 and an OR circuit 103. Since there are 16 columns on the cylinder 24, the shift register 100 is a 16-step register. Each character is stored in the shift register 100 and fed in sequence to a character generator 102 which converts the character to a code which discloses which segment *a–h* is to be printed. The fifteen outputs 102*a*–102*o* of the generator 102 thus transmit in parallel form signals which represent one character. For example, if the letter P has been applied in code form to the generator 102, the outputs 102*b* transmit *c, f, g* and *i* signals, which represent said letter and which comprise the segments *a* (positions II and IV), *b* (positions III and V) and *f* (position III).

A counter 104 associated with the 33 program steps in FIG. 8 counts 33 times during each working cycle, i.e., during two revolutions of the cylinder 24. The counter 104 is cleared every other time the switch 92 is closed. Each time the counter 104 is advanced through one step a code which represents one of the program steps illustrated in FIG. 8 is applied to a character generator 106 connected to the counter 104 via the conductor lines 104*a–f*. Thus, program step 1 (P1) in FIG. 8 is applied in code form to the character generator 106 via the line 104*a* immediately after the counter 104 has been cleared, program step 2 (P2) is applied to the generator on the next step of the counter via the line 104*b*, program step 3 (P3) is applied to the generator via lines 104*a* and 104*b* on a further step of the counter, etc. Since the counter 104 is a 6-bit binary counter, up to 63 program steps can be applied to the generator 106. As will be seen from FIG. 8, however, only 33 program steps are required with the illustrated embodiment.

The character generator 106 converts each step of the counter 104 to a code which discloses what is to take place during the different working steps. If, for example, a signal is transmitted on line 106*p*, this means that an electromagnet 30 connected thereto via an amplifier 107 is to be energized, i.e., the magnet is to turn the cylinder one step, i.e., 45° (program 4, 6, 8, 10, 11, 13, 15, 16, 18, 20, 21, 23, 25, 27, 29 and 31). If a signal is transmitted on line 106*g*, this means that the electromagnet 56 connected thereto via an amplifier 109 is to be energized, i.e., the magnet is to move the slip 14 one step (program 2, 4, 13, 18, 27 and 33). The other fifteen outputs 106*a–o* on the generator 106 thus transmit signals representing the different segments *a–h*, a signal on the output 106*a* denoting the segment *a* in position I (program step 1), a signal on the output 106*b* denoting the segment *a* in position II (program step 3), a signal on the output 106*c* denoting the segment *b* in position III (program step 5), etc.

The signals from the character generators 102 and 106 are transmitted to a comparison unit 108. If, for example, a signal representing segment *a* in position I is on line 102*a* when a signal is on line 106*a* (program step 1), the comparison unit 108 sends a signal on line 108*a* indicating that segment *a* in position I shall be printed. If there is no signal on line 102*a* when a signal is sent on line 106*a*, no signal is obtained on line 108*a*, i.e., the segment *a* in position I shall not be printed. Thus, if there is agreement between a signal or any of lines 102*a–o* and a signal on corresponding lines 106*a–o*, a signal will be sent on line 108*a*.

The comparison unit 108 is connected via the line 108*a* to a pulse distributor 110, to which latter the sixteen outputs 112*a–p* from a ring counter 112 are connected. Clock pulses are sent to the counter 112 via the line 114. Clock pulses are also sent to the shift register 100 via the OR-circuit 103 when reading the register. The ring counter 112 has a counting cycle of 16, which corresponds to the number of columns on the slip or ribbon 14. During each count cycle the counter 112 will send in sequence pulses to the pulse distributor 110, via the lines 112*a–p*, sunchronously with the signals arriving at the distributor, via the line 108*a*, from the shift register 100, the character generator 102 and the comparison unit 108. Thus, the distributor 110 will send signals to the electromagnets 44 located under the columns on slip 14 to be printed, i.e., if a signal is on line 108*a* simultaneously as the counter 112, for example, sends a signal on lines 112*b* and 112p segments will be printed in columns 2 and 16. An amplifier 116 is arranged between the distributor 110 and the electromagnets 44.

It is believed that the mode of operation of the inventive printing device will be evident from the aforegoing. For the sake of completeness, however, the manner in which the letter T and the numeral 3 are printed in respective columns 1 and 6 will be briefly described.

Coded signals representing the letter T and the numeral 3 and arriving from the calculating machine (not shown) connected to the printing device are clocked into the shift register 100 in its steps 1 and 6. The cylinder 24, which occupies its starting position, i.e., is opposite the segment *a*, has just set the switch 92 to its off position and the counter 104 has counted one step, i.e., to program step 1. The character generator 106 connected to the counter 104 then sends a signal on line 106*a* to the comparison unit 108. When reading the register 100, by means of clockpulse on line 114, no signal is sent to the comparison unit 108 from the character generator 102 since there is no signal on the corresponding line 102*a*. The comparison unit 108 will not therefore produce a signal and hence all electromagnets remain inactive.

The counter 104 counts a further step (program step 2) and a signal is sent only on line 106*g*. This causes the electromagnet 56 to be energized and the shaft 46 to be turned one step, which means that the slip 14 is advanced in the direction of arrow A through a distance corresponding to the distance between positions I and II.

At program step 3, the line 106*b* conducts a signal to the comparison unit 108. With a signal on the clock pulse line 114 step 1 (corresponding to column 1) in the shift register 100 is fed to the character generator 102 at the same time as this step is passed back into the last step, i.e., the sixteenth step, of the circular shift register. Since the letter T includes the segment *a* in position II, the character generator 102 sends a signal on line 102*b*. The comparison unit 108 then sends a signal on line 108*a*. Since the ring counter 112 operates synchronously with the read-out of the shift register 100, it has counted one step when the signal on line 108*a* is passed to the distributor 110, and hence the electromagnet 44 in column 1 causes the segment *a* to be printed in position II. With steps 2–5 of the counter 112 and simultaneous stepping of the shift register 100 (corresponding to columns 2–5 on slip 14) no printing takes place, since there is no signal on line 108*a*. When the counter has counted to six (corresponding to column 6) there is again a signal on line 108*a*, since a signal has again been applied to line 102*b* from the shift register 100 via the character generator 102. Consequently the segment *a* in position II will be printed in column 6, since the electromagnet 44 in this column is energized. Since the remaining columns 7–16 shall not contain segment *a* in position II, no signal is obtained on the line 102*b*, and therewith on the line 108*a*, when the counter 112 counts steps 7–16.

In program step 4 the character generator 106 only sends signals on lines 106*p* and 106*q*, and hence the cylinder is turned through 45° and the electromagnet 56 causes the slip 14 to be moved one step in the direction of arrow A. Thus, no printing takes place.

In program step 5 a signal is sent to the comparison unit 108 via the line 106*a*, while the counter 112 counts 16 steps and the shift register 100 shifts 16 times. Since no segment *b* in position III is to be printed in any column, the electromagnets remain inactive.

In program step 6 only the electromagnet 30 is energized and the cylinder is rotated a further step, i.e., 45°, so that the segment *c* on cylinder 24 is located immediately above the printing position.

In program step 7 none of the magnets are energized, since segment *c* is not to be printed in any column.

In program step 8 the cylinder 24 is turned a further step, so that segment *d* is located immediately above the printing position.

In program step 9 a signal is sent to the comparison unit 108 via line 106*e*. With the first clock pulse on line 114 the code again present in the first step of the shift register 100 is sent to the character generator 102 and the ring counter 112 is advanced one step. Since the segment *d* in position III shall be printed in column 1, the line 102*e* will conduct a signal to the comparison unit 108, which sends a signal on line 108*a* to the distributor generally simultaneously as the counter 112 is moved said step, the electromagnet 44 in column 1 being energized and the segment *d* being printed in position III. Since no further signal is obtained from line 102*e* of the character generator 102 during the continued fifteen steps of the shift register 100 and the counter 112, the segment *d* in position III will not be printed in further columns.

In program steps 10 and 11 the cylinder 24 is rotated.

In program step 12 segment *f* of the cylinder 24 is located immediately above the printing position. This segment is only to be printed in column 6 and hence only with the 6th cyclic stepping of the shift register 100, when a signal is on line 102*f* and also on line 106*f*, will the distributor combine the signal from the counter 112 and the signal on line 108*a* to a signal which causes the magnet 44 in the sixth column to be energized.

The mode of operation of the device in performing the remaining program steps for forming the letter T and the numeral 3 in columns 1 and 6 will be readily understood from the aforegoing. Subsequent to printing a complete row on the slip 14, the slip is advanced one step (program 33) to begin a new row. With the illustrated embodiment the row spacing will thus be equal to the distance between two adjacent positions in FIG. 7. It is, of course, possible to incorporate, for instance, two additional program steps F for advancing the slip 14, whereby the spacing thus obtained will correspond to the distance between positions I and IV.

Although the invention has been described above with reference to a particular embodiment thereof, it will be understood that a number of modifications can be made without trespassing from the concept of the invention. For instance a different number of segments can be selected to the eight segments *a–h* used with the described embodiment. Thus, two segments can be added, of which one is arranged between segments *d* and *f* and extends from the point of intersection between segment *a* in position II and segment *f* in position III to the point of intersection between segments *c* and *d* in position III, while the other extends from the point of intersection between segment *a* in position IV and segment *d* in position V to the point of intersection between segment *b* in position V and segment *a* in position VI. In this way it is possible to form a large number of characters. This requires, however, an increased number of program steps and a further two segments on the cylinder 24. If the printing device is to be used solely to print numerals, segments *c*, *e* and *h* can be removed, therewith also reducing the number of program steps.

It is also possible to replace segments *a–h* with dots, said dots being arranged spirally around the periphery of the cylinder. For instance, a matrix having 5×7 dots can be provided by arranging in each column five dots spirally around the periphery of the cylinder and by rotating the cylinder seven revolutions. It is also possible to arrange several groups of five dots around the periphery of the cylinder, thereby reducing the number of revolutions through which the cylinder need be rotated. For instance, if two groups of five dots are used, the cylinder need only be rotated four times.

One course, the number of program steps is increased or decreased with a respective increase or decrease in the number of segments in the form of lines or dots, and in this case the circuits shown in FIG. 9 must be modified.

Instead of the control means shown in FIG. 9, the magnets 30, 56 and 44 may be energized by a microcomputer, which is programmed for example according to the pattern shown in FIG. 8 to perform all types of existing control functions, check functions etc.

The invention is therefore only restricted by the disclosures of the accompanying claims.

I claim:

1. A printing device for printing characters onto a record medium comprising:

a printing station;

carrier means provided with a plurality of character segments, said character segments being adapted to collectively define an entire font of characters;

moving means for intermittently moving said carrier means to thereby move a particular one of said character segments through said printing station during each such intermittent movement of said carrier means;

record feeding means for intermittently feeding said record medium through a predetermined amount through said printing station;

hammer means for striking said record medium against said carrier means; and control means for controlling said moving means and said record feeding means in a predetermined sequence of steps;

said moving means moving said carrier means under control of said control means during particular steps in said predetermined sequence of steps;

said record feeding means feeding said record medium through said predetermined amount under control of said control means during certain steps in said predetermined sequence of steps;

said carrier means and said record medium being independently moved during specified steps and being simultaneously moved during other specified steps in said predetermined sequence of steps;

said control means selectively actuating said hammer means to thereby print the particular one of said character segments located at said printing station onto said record medium; whereby a character is formed by selective actuation of said hammer means after controlled movement of said carrier means and said record medium.

2. A printing device as set forth in claim 1, further including:

a plurality of carrier means each being provided with a plurality of character segments; and a plurality of hammer means;

each of said hammer means being associated with a corresponding carrier means.

3. A printing device as set forth in claim 2, wherein:

said carrier means comprises a cylindrical member;

said character segments being disposed about the surface of said cylindrical member in a plane substantially perpendicular to the axis of said cylindrical member.

4. A printing device as set forth in claim 3, wherein:

said cylindrical member is angularly moved by a predetermined fraction of its circumference length during said particular steps in said predetermined sequence of steps; and said predetermined amount of feeding of said record medium is substantially equal in length to said predetermined fraction of said cylindrical member circumferential length.

5. A printing device as set forth in claim 4, wherein:

said predetermined fraction of said cylindrical member circumferential length subtends an angle of substantially 45°.

* * * * *